United States Patent [19]

Sogo et al.

[11] Patent Number: 5,057,804

[45] Date of Patent: Oct. 15, 1991

[54] DIELECTRIC RESONATOR CIRCUIT

[75] Inventors: Hiroyuki Sogo; Hideo Ashida; Hideo Sugawara, all of Otawara; Yasuyuki Kondo, Nishinasunomachi, all of Japan

[73] Assignee: Fujitsu Limited, Kawasaki, Japan

[21] Appl. No.: 492,830

[22] Filed: Mar. 13, 1990

[30] Foreign Application Priority Data

Mar. 14, 1989 [JP] Japan ..... 1-61593
Jul. 21, 1989 [JP] Japan ..... 1-189600

[51] Int. Cl.[5] ..... H01P 7/10
[52] U.S. Cl. ..... 333/219.1; 333/202
[58] Field of Search ..... 333/219.1, 219, 202, 333/208-212, 204, 227

[56] References Cited

U.S. PATENT DOCUMENTS 4,423,397 12/1983 Nishikawa et al. ..... 333/219.1
4,821,006 4/1989 Ishikawa et al. ..... 333/129.1 X
4,881,051 11/1989 Tang et al. ..... 333/219.1 X

FOREIGN PATENT DOCUMENTS 0014202 1/1982 Japan ..... 333/219.1
0299603 12/1988 Japan ..... 333/219.1

OTHER PUBLICATIONS

Patent Abstract of Japanese 1-144701 published Jun. 7, 1989, Dielectric Resonator.

Nishikawa et al., "Dielectric High-Power Bandpass Filter Using Quarter-Cut $TE_{01\delta}$ Image Resonator for Cellular Base Stations", *IEEE Transactions on Microwave Theory and Techniques,* vol. MTT-35, No. 12, Dec. 1987, pp. 1150-1155.

*Primary Examiner*—Eugene R. LaRoche
*Assistant Examiner*—Seung Ham
*Attorney, Agent, or Firm*—Staas & Halsey

[57] ABSTRACT

A resonator element formed of a half or a quarter of dielectric cylinder contacts an electrically conductive plane via the resonator element's radially cut side which includes the axis of the cylinder, accordingly, resonates in $TE_{01\delta}$-mode. On an opposite side of the electrically conductive plane there is provided an unbalanced transmission line, for example, of a strip line type or a coaxial line type. An end of the transmission line is electromagnetically coupled via a dielectric material in the transmission line or directly with the radially cut side of the resonator element through an opening provided on the electrically conductive plane. Coupling circuit according to the present invention allows a compact overall circuit configuration.

24 Claims, 10 Drawing Sheets

DIELECTRIC RESONATOR CIRCUIT

BACKGROUND OF THE INVENTION

1. Field of the Invention

The present invention relates to a coupling circuit of a transmission line to a dielectric resonator.

2. Description of the Related Art

A prior art $TE_{01\delta}$ mode dielectric resonator employed in a bandpass filter and the method of coupling with its external circuit are shown in FIG. 1 through FIG. 3. In FIG. 1, between two standard waveguides (i.e. $TE_{10}$ mode waveguides) 1 and 1' there is connected a second waveguide 2 which is in a cut-off state for the electromagnetic wave to be now transmitted through the standard waveguides 1 and 1'. A $TE_{01\delta}$ mode cylindrical dielectric resonator element 3 is installed in the second waveguide 2 via a metal stage 4 mounted on its side wall parallel to the larger side walls of the standard waveguides 1 and 1'. The resonator element 3 is coupled magnetically, i.e. via magnetic flux, with both the standard waveguides 1 and 1', so as to allow only the resonator element's resonant frequency to transmit through the cut-off waveguide 2. In this circuit configuration, the stage 4 causes an increase in space occupancy of the circuit.

In order to reduce the space occupancy, a configuration shown in FIG. 2 has been proposed, such as disclosed in Japanese TokuKai Hei-1-144701. In this circuit configuration, a half-cut cylindrical dielectric resonator element 5 has its flat surface adhered to a shorter side wall of the cut-off waveguide 2, and is magnetically coupled with the standard waveguides 1 and 1'.

In FIG. 3, a half-cut dielectric resonator element 5 is adhered on an inner wall of a metal case 7 so as to interconnect coaxial lines 6 and 6'. In this circuit configuration, an extension of each of the inner conductors of the coaxial lines 6 and 6' is terminated on the metal case 7 and forms a loop 6*a* which is magnetically coupled with the half-cut cylindrical resonator element 5.

However, there are problems in that in the FIG. 2 configuration the overall circuit size is little reduced even though the resonator element is reduced into a half size; and in the FIG. 3 configuration the loops 6*a* require the space in the case 7. The same problem is in a circuit configuration employing a quarter cut $TE_{01\delta}$-mode dielectric resonator element reported in "IEEE Transaction on Microwave Theory and Techniques", vol. MTT-35, No. 12, December 1987, p.1150–1155. Thus, there is no much likelihood of further size reduction in the above-described circuit configuration. Therefore, a new coupling circuit which can enjoy the advantage of the compact half or quarter cut cylindrical dielectric resonator has been expected.

SUMMARY OF THE INVENTION

It is a general object of the invention, therefore to provide a compact circuit configuration for coupling a half or quarter-cut cylindrical $TE_{01\delta}$-mode dielectric resonator to an outer transmission line.

It is another object of the invention to provide a circuit configuration suitable for mounting a half or quarter-cut cylindrical $TE_{01\delta}$-mode dielectric resonator onto a printed circuit board.

A resonator element formed of a half or a quarter of dielectric cylinder contacts an electrically conductive plane via the resonator element's radially cut side which includes the axis of the cylinder, accordingly, resonates in $TE_{01\delta}$-mode. On an opposite side of the electrically conductive plane there is provided an unbalanced transmission line, for example, of a strip line type or a coaxial line type. An end of the transmission line is electromagnetically coupled, via a dielectric material in the transmission line or directly, with the radially cut side of the resonator element through an opening provided on the electrically conductive plane.

The above-mentioned features and advantages of the present invention, together with other objects and advantages, which will become apparent, will be more fully described hereinafter, with reference being made to the accompanying drawings which form a part hereof, wherein like numerals refer to like parts throughout.

BRIEF DESCRIPTION OF THE DRAWINGS

FIG. 13(*c*) show the opposite side of the ceramic substrate shown in FIG. 13(*b*);

DESCRIPTION OF THE PREFERRED EMBODIMENTS

Figure 4:
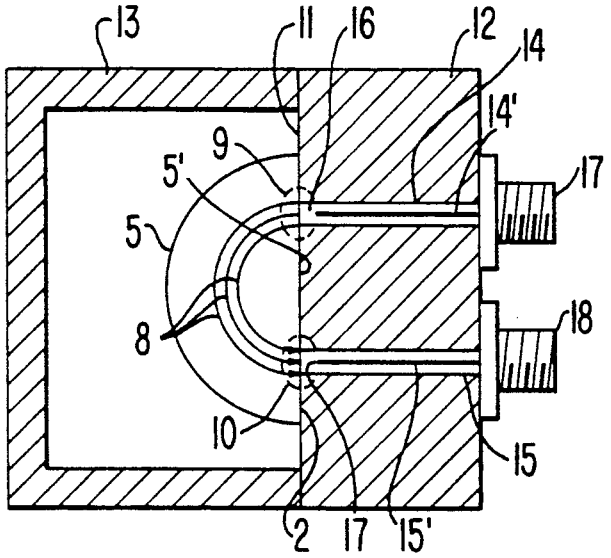
FIGS. 4(*a*) and 4(*b*) schematically illustrate a first preferred embodiment of the present invention employed for connection with coaxial transmission lines.
Figure 4:
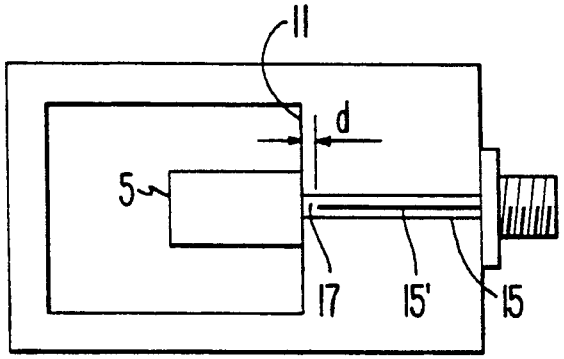

FIG. 4(*a*) shows a cross-sectional plan view, and FIG. 4(*b*) shows a cross-sectional side view, of a first preferred embodiment of the present invention A dielectric resonator element 5 is formed of a dielectric material, such as $(ZrSn)TiO_4$ whose dielectric constant is as high as 36.5 or $Ba_2Ti_9O_{20}$ whose dielectric constant is 39.8. The dielectric resonator 5 is in the shaped of a half-cut cylinder having a flat side 5' which includes the axis (not shown in the figure) of a dielectric cylinder of, for example, 6 mm diameter. The flat side 5' is referred to hereinafter as a radially cut side. The half-cut cylinder is also cut with two planes orthogonal to the axis of the cylinder so as to leave, for example, 2.3 mm thickness. The radially cut side 5' is adhered to a metal wall 11 of a resonator base 12 typically with a generally available epoxy resin. The metal wall 11, being electrically conductive, acts as a mirror to form an image of the half-cut cylinder dielectric resonator element 5, so that the half-cut cylindrical dielectric resonator element 5 resonates in a $TE_{01\delta}$-mode like a fully cylindrical dielectric resonator element. Resonant frequency of the resonator element varies depending on the element's dimensions and the dielectric constant of the element's material. First and second coaxial transmission lines 14 and 15, each having typically 50 ohm characteristic impedance, are provided vertically to the metal wall 11 through the resonator base 12. Each of coaxial transmission lines 14 and 15 is typically composed of 2.1 mm outer diameter, 0.63 mm inner conductor diameter, and Teflon ($CF_4$) filled therebetween. End 16 and 17 of each inner conductor 14' and 15' of respective coaxial transmission lines 14 and 15 faces the radially cut side 5' via a predetermined distance d (denoted in FIG. 4(*b*)), for example, 0.5 mm. An electromagnetic wave signal transmitted on the inner conductor 14' of the first coaxial transmission line 14 is electromagnetically coupled to the radially cut side 5' of the resonator element 5 via capacitance formed at the above-described distance. That is, current flowing from the inner conductor 14' through the capacitance excites the resonator element 5, and further flows along the $TE_{01\delta}$ mode electric field 8 in the resonator element 5 shown in FIG. 4(*a*). The term "coupling" is referred to so as to express this phenomena. This current reaches the inner conductor 15' of the second coaxial line 15, in the same but reverse way as the first coaxial line 14, only when the frequency of the signal causes $TE_{01\delta}$ mode resonance in the resonator element 5. Other frequency than the resonant frequency does not reach the second coaxial line 15 and reflects back to the first coaxial line 14. Thus, the resonator element 5 acts as a band pass filter. The other ends of the coaxial lines 14 and 15 are connected to coaxial connectors 17 and 18, respectively. Thus, the circuit of FIG. 4 can be handled as an independent filter, easily detachable from coaxial cables. Metal cap 13 is electrically connected, for example soldered, to the resonator base 12 so that the resonator element 5 is confined in its cavity as well as shielded from other circuits.

Electric field strength expressed with density of electric fields 8 is weak at the peripheral portion or at the centre portion of the half-cut cylinder 5. A coaxial transmission line connected to the higher electric field portion provides a closer coupling, as well as less coupling at a weaker electric field portion. Therefore, the coupling between the transmission line and the resonator element 5 can be varied by choosing the location of the transmission lines 14 and 15 along the radial direction of the dielectric cylinder. The coupling between the transmission line and the resonator element 5 can be adjusted also by the capacitance value at the distance between the inner conductor ends 16 or 17 and the radially cut side 5' of the resonator element 5. The closer coupling between the transmission line and the resonator element 5 provides the wider pass-band width of the filter.

In order to achieve impedance matching of the input transmission line 14, locations of the two transmission lines 14 and 15 are preferably chosen at the symmetric positions with respect to the axis of the resonator element 5.

Figure 5:
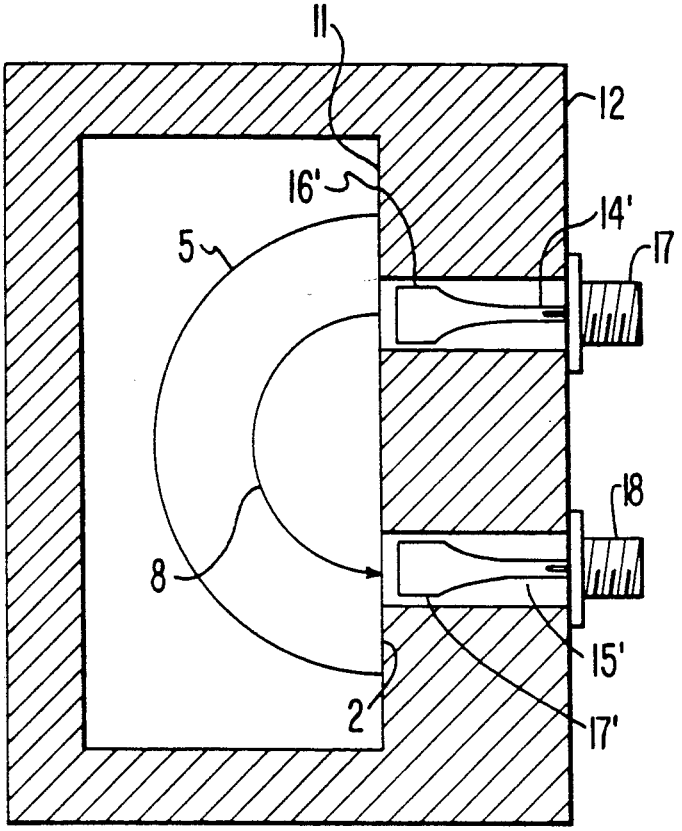
FIG. 5 schematically illustrates a second preferred embodiment.

FIG. 5 shows a second preferred embodiment of the present invention, as a modification of FIG. 4 first preferred embodiment. Each of inner conductors 14' and 15' and their ends 16' and 17', of the coaxial lines, are printed on a ceramic substrate (not shown in the figure). The ends 16' and 17' are made wider than the 50 ohm transmission line portion 14 and 15 so as to form a properly increased capacitance with the radially cut side 5' of the resonator element 5. In order to adjust the capacitance, the shape of the ends 16' and 17' can be adjusted by removing the printed conductor by means of, for example, sand blasting. Advantage of FIG. 5 configuration is in that the coupling capacitance value can be precisely controlled.

Figure 6:
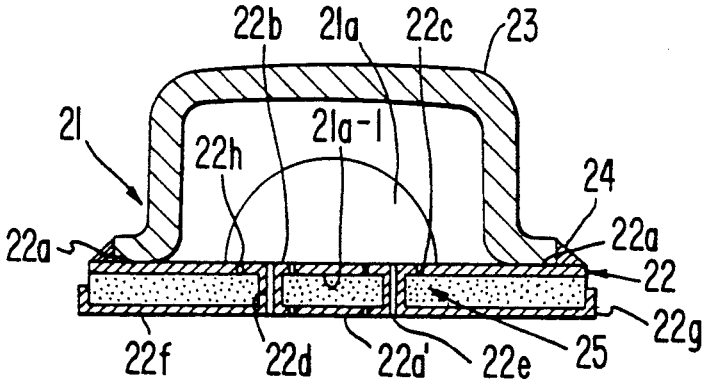
FIG. 6 shows a vertically cut side view of a third preferred embodiment of the present invention.
Figure 7:
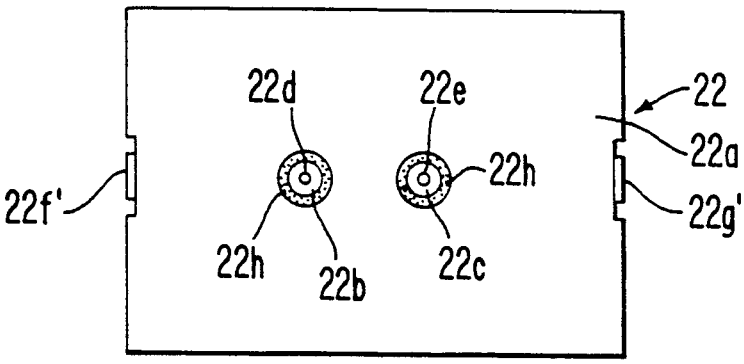
FIG. 7 shows an inner side plan view of a ceramic substrate employed in FIG. 6 embodiment.
Figure 8:
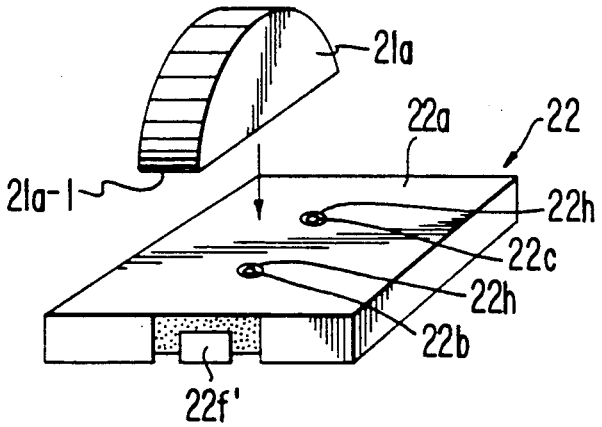
FIG. 8 shows a perspective view of the components employed in FIG. 6 embodiment.
Figure 9:
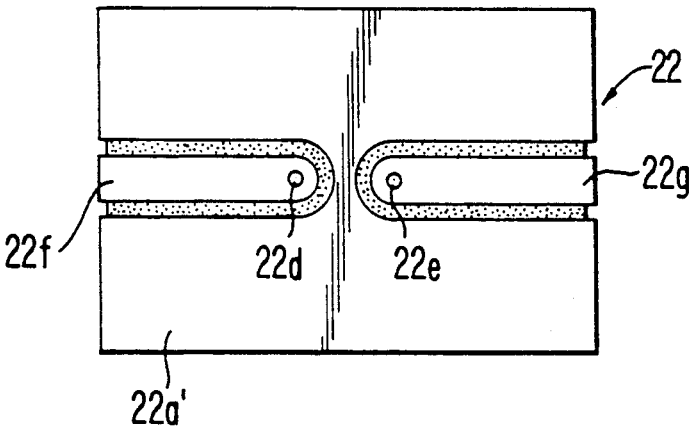
FIG. 9 shows an outer side plan view of the ceramic substrate employed in FIG. 6 embodiment.
Figure 10:
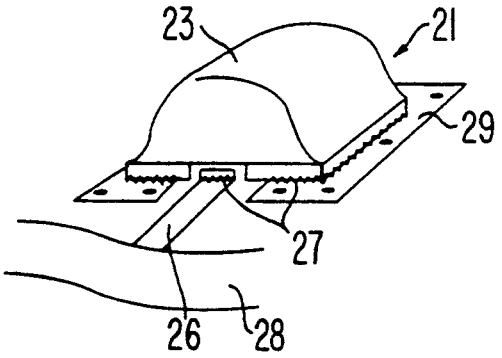
FIG. 10 shows a perspective view of the complete FIG. 6 filter.

A third preferred embodiment of the present invention, where the input and output transmission line circuits are formed of strip line type transmission lines, is schematically illustrated in FIG. 6 showing a vertically cut cross-sectional view; FIG. 7 showing an inner surface plan view of its ceramic substrate; FIG. 8 showing a perspective view of the composing elements; FIG. 9 showing an outer surface plan view of the ceramic substrate; and FIG. 10 showing a perspective view of the complete filter mounted on a mother board. According to a widely employed method, electrically conductive planes 22*a* of, for example, copper, is formed upon a surface of, for example, a 0.65 mm thick alumina ceramic substrate 22, and is provided with two openings 22*h* of typically 0.8 mm diameter and spanned by 2 mm, by chemical etching or sandblasting so as to expose part of the ceramic substrate 22, while circular patterns 22*b* and 22*c*, as coupling electrodes, are left at the centre of each opening. In the same way, on the other surface of ceramic substrate 22, there are formed an input strip electrode 22*f*, an output strip electrode 22*g*, each having 0.6 mm width, and a ground plane 22*a'*. Shorter sides of substrate 22 may be also coated with an electrically conductive material so that both the ground planes 22*a* and 22*a'* are electrically connected. Each of strip electrodes 22*f* and 22*g*, together with this side of ground plane 22*a* and the 0.65 mm thick ceramic substrate therebetween, constitute strip-line type 50 ohm transmission line. Hatched portions in FIGS. 4 and 5 indicate the exposed ceramic substrate 22. At the centers of coupling electrodes 22*b* and 22*c*, there are provided through-holes 22*d* and 22*e* coated with electrical conductive material so as to electrically connect each of the coupling electrode 22*b* and 22*c* to ends of the strip electrodes 22*f* and 22*g*, respectively. Each of the opposite ends 22*f'* and 22*g'* of strip electrodes 22*f* and 22*g* vertically extends along thin side of the ceramic substrate 22 so as to be terminals to be connected with external circuit by soldering. Resonator element 21*a* is substantially the same as the resonator element 5 used in the first preferred embodiment. The radially cut side 21*a*-1 of the resonator element 21*a* is adhered onto the metal plane 22*a* as well as the openings 22*h*, in the same way as those of FIGS. 4 and 5. A metal cap 23 is soldered onto the metal plane 22*a* in order to shield the resonator element 21*a* from the other circuits, as denoted with the numeral 24. Thus completed filter unit 21 is mounted onto a mother circuit board 28 by soldering the ground planes 22*a* and 22*a'* onto a ground plane 29, as well as terminals 22*g'* and 22*f'* to a strip electrode 26, each of a mother circuit board 28. Degree of the coupling between the transmission line and the resonator element is determined by the size of openings 22*h*, the size of the coupling electrodes 22*b* and 22*c* and the location of the openings measured from the axis of the half cylinder. The coupling electrodes 22*b* and 22*c* provide relatively large capacitance value, resulting in a close coupling with the resonator element 21*a*.

In order to achieve relatively loose coupling with the resonator element 21*a*, the coupling electrodes 22*b* and 22*c* and the through-holes 22*d* and 22*e* may be omitted. This case is not shown in the figure. In this case, the degree of the coupling is determined by the capacitance between the strip electrode and the resonator element, that is, by the size of the opening, the area of the strip electrode facing the resonator electrode through the opening, and the thickness as well as dielectric constant of the ceramic substrate 22 existing therebetween.

Figure 11:
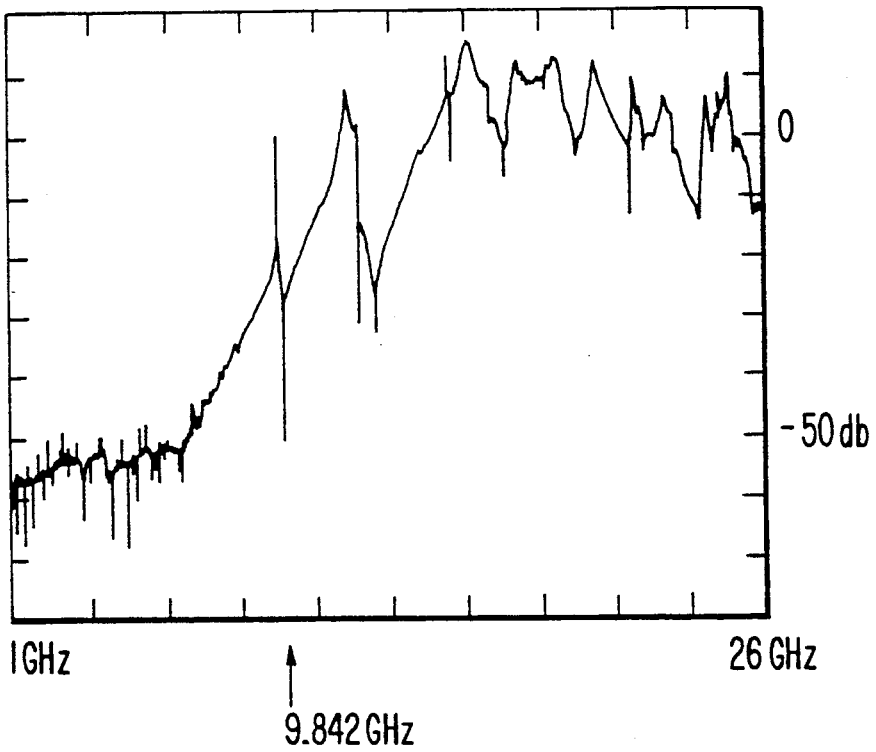
FIG. 11 shows bandpass characteristics of FIG. 6 filter.
Figure 12:
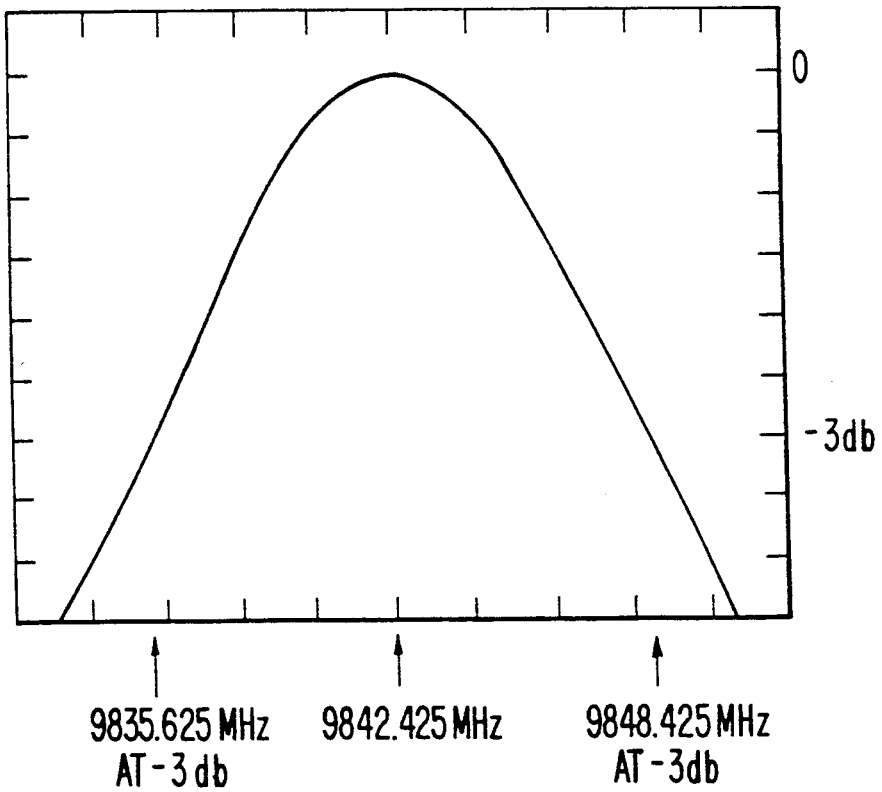
FIG. 12 shows an enlargement of FIG. 11 bandpass characteristics in the vicinity of the resonant frequency.

Bandpass characteristics of FIG. 6 filter are shown in FIGS. 11 and 12. FIG. 11 shows frequency characteristics from 1 to 26 GHz, where a peak at 9.848 GHz is of the $TE_{01\delta}$ mode resonance of the resonator element, while other peaks existing at higher frequency band than the $TE_{01\delta}$ mode resonance are of higher mode resonances of the resonator element and of the resonance of the cavity formed with cap 23. FIG. 12 shows an enlargement of the FIG. 11 bandpass characteristics in the vicinity of the $TE_{01\delta}$ mode resonance. The $-3$ db band width is 12.8 GHz for the centre frequency 9848.425 MHz, and the insertion loss is 16.5 db. The insertion loss will be much reduced by employing more suitable material for adhering the resonator element to the substrate.

Figure 1:
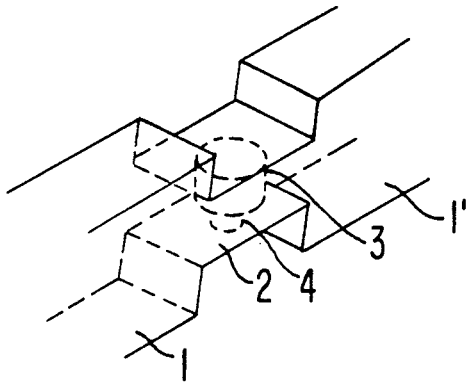
FIG. 1 PRIOR ART
FIG. 1 schematically illustrates a prior art bandpass filter employing a $TE_{01\delta}$-mode cylindrical resonator element, where the side-walls of the waveguides are not shown for simplifying the drawing.
Figure 2:
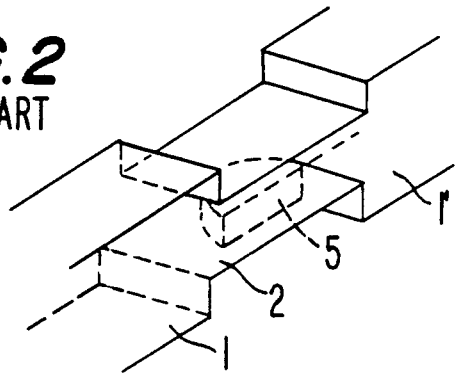
FIG. 2 PRIOR ART
FIG. 2 schematically illustrates a prior art bandpass filter employing a $TE_{01\delta}$-mode half-cut cylinder resonator element, where the side-walls of the waveguides are not shown for simplifying the drawing.
Figure 3:
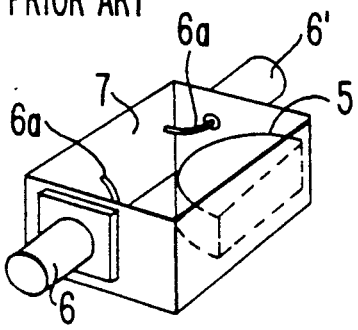
FIG. 3 PRIOR ART
FIG. 3 schematically illustrates a prior art bandpass filter employing a $TE_{01\delta}$-mode half-cut cylindrical resonator element, connected with coaxial transmission lines.

Size of bandpass filter unit 21 shown in FIG. 6, used for 10 GHz band, achieved 7 mm high$\times$8$\times$14 mm cap and 12 $\times$18 mm substrate. Thus, the filter volume is as small as approximately 1.4 cc, which is a half of 2.8 cc of case 7 in FIG. 3 of the prior art filter employing coupling loops. Moreover, FIG. 6 structure is suitable for being easily handled and mounted on a strip line type mother circuit board, which is the most commonly employed today, as well as allows the mother board to be compactly finished.

Figure 13:
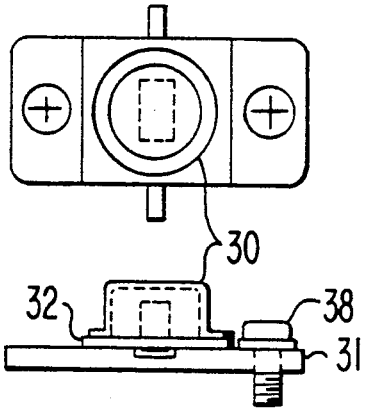
FIGS. 13(*a*) and 13(*b*) show a fourth preferred embodiment of the present invention.
Figure 13:
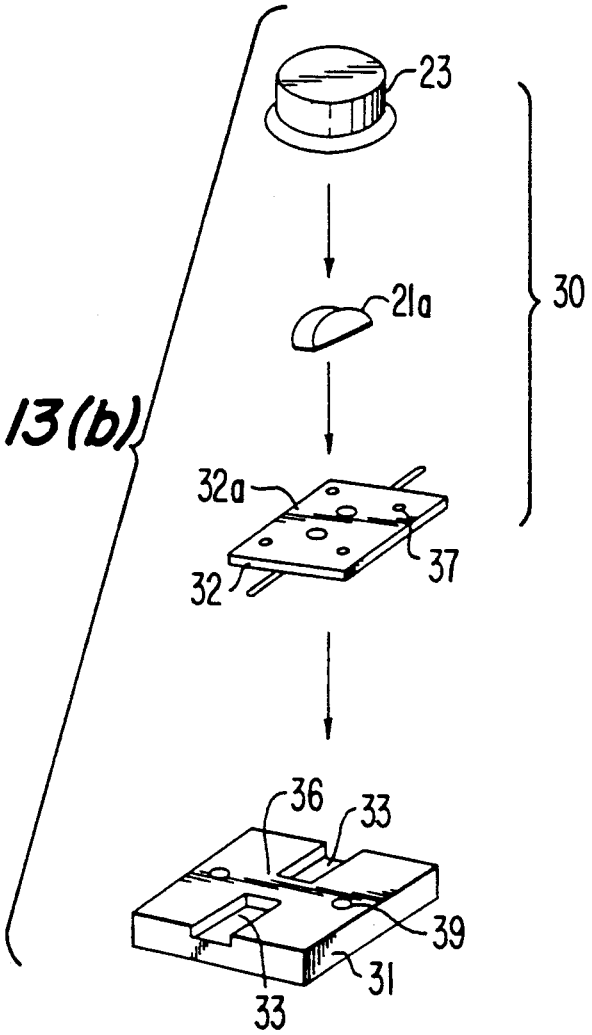
Figure 13:
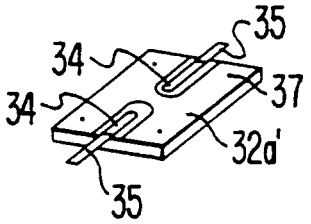

A variation of the substrate embodied in the third preferred embodiment is shown in FIGS. 13(*a*) and 13(*b*). FIG. 13(*b*) explains assembling of the components. FIG. 13(*c*) shows the opposite surface of ceramic substrate 32 shown in FIG. 13(*b*). Cap 23 and resonator element 21*a* are substantially the same as those of FIG. 6. Ground planes 32*a* and 32*a'* coated on the both surfaces of ceramic substrate 32 are electrically connected with each other via a plurality of through-holes 37 provided through the ceramic substrate 32 or via metal coat on the short sides of the ceramic substrate 32, and are soldered to a metal substrate 31. Metal substrate 31 is provided with two channels 43, which are, for example, 3 mm wide, 0.7 mm deep, and extend so as to face the strip electrodes 34. Between the two channels there is left a 1 mm wide bank 36. When ceramic substrate 32 is fixed onto metal substrate 31, the strip electrodes 34 are electromagnetically shielded in channels 33, respectively. Bank 36 act as an electromagnetic shield between input and output transmission lines 34. Strip electrodes 34 do not need extended portion 22*f'* and 22*g'* along the short sides of the ceramic substrate 22 as in FIG. 8. However, each end of strip electrodes 34 is extended with ribbon electrode 35 soldered thereto. Metal substrate 31 having the filte unit 30 thereon is fixed to a mother board (not shown in the figure) with screws 38 penetrating the openings provided on the metal substrate 31, then the ribbon electrodes 35 being flexible are easily soldered to a circuit on the mother board. This configuration allows an easy handling as well as quick mounting of the filter unit onto the mother board.

A fourth preferred embodiment of the present invention is shown in FIGS. 14, where a plurality of the resonator elements 43A through 43C are employed in a single case 412. FIG. 14(*a*) shows a perspective view of the filter unit, whose top lid 412' is disassembled. FIG. 14(*b*) shows a cross-sectional plan view of FIG. 14(*a*) filter. Each of the resonator elements 43A through 43C is essentially the same as that of FIG. 4 first preferred embodiment. Radially cut sides 42A, 42B and 42C of respective resonator elements 43A through 43C are adhered in line onto a metal wall 41 of case 412. A coaxial input terminal 417 according to the structure of FIG. 4 first preferred embodiment or FIG. 5 second preferred embodiment is arranged so as to couple the first resonator element 43A, at a farther side than the axis of the half cylinder of the resonator element 43A from the next resonator element 43B. The resonator element 43B located between the first and the last resonator elements is provided with no external coupling means through the wall 41. Each of the resonator elements 43A through 43C is mutually coupled with the adjacent resonator element by magnetic flux 49A and 49B of the $TE_{01\delta}$ mode as shown with dotted lines. Signal input from the input terminal 417 exciting the first resonator element 43A thus propagates along on each resonator element to the last resonator element 43C. A coaxial output terminal 418 similar to the input terminal 417 is provided so as to couple the last resonator element 43C, at the farther side from the previous resonator element 43B with respect to the axis of the half cylinder of the resonator element 43C. Thus, only the resonant frequency of the resonator elements 43A through 43C can be output from the output terminal 418. Degree of the mutual coupling between the neighbouring resonator elements determined by their distance determines the filter's pass-band width. A metal lid 412' covers the top opening of the case 412. Metal screws 49A through 49C are provided in screw holes on metal lid 412', and extends therefrom to over respective resonator elements. Resonant frequency of each resonator element can be finely adjusted by rotating the corresponding screw. The FIGS. 14 configuration is advantageous in that the space occupied by the coupling loops from/to the input/output circuit can be saved. It is apparent that FIG. 6 strip-line type input/output circuit can be also embodied in FIG. 13 multiple resonator element configuration, though no figure is given therefor.

Though in FIGS. 14 fourth preferred embodiment the input and output terminals 417 and 418 are located respectively farther sides than each element axis, it is apparent that the input and/or output terminal(s) may be located nearer side than respective element axis as denoted with arrows 417' and 418'.

Figure 15:
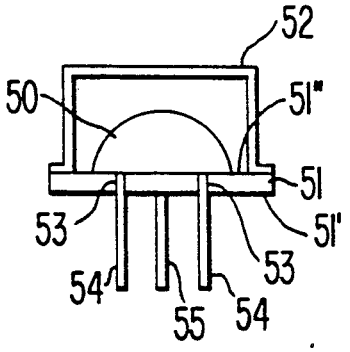
FIG. 15 shows a sixth preferred embodiment of the present invention.

FIG. 15 shows a filter unit as a fifth preferred embodiment of the present invention This configuration is suitable for a use in relatively low frequency band, such as below several hundreds Mega Hertz band. Therefore, sizes of resonator element 50, ceramic substrate 51 and cap 52 are larger than those of FIG. 4 or FIG. 6 configuration; however the structures are quite similar thereto, except that the outer surface 51' of substrate 51 has no coaxial lines nor strip electrodes. Electrically conductive through-holes 53 are provided through the ceramic substrate 51 so as to face the centers of the openings of the metal plane (not shown in the figure) on the inner surface 51'' of the substrate. Diameter of the through-holes, locations of the through-holes, and the distance between the ends of the through-holes and the radially cut side of the resonator, determine the degree of the coupling. Therefore, coupling electrodes may be additionally provided at the ends of the through holes as the FIG. 7 configuration. Electrically conductive leads 54 are soldered to the through-holes 53, as input and output terminals of the filter unit from and to other circuit. When a loose coupling is required, the above-described electrically conductive through-holes may be omitted, and a coupling electrode (not shown in the figures) may be provided on the outer surface 51' of the ceramic substrate 51 in place of the through-holes. Then, leads 54 are soldered to the coupling electrodes on the outer surface 51'. Outer ground plane (not shown in the figure) coated on the outer surface 51' of the substrate 51 is connected to inner ground plane via the electrically conductive through-holes (not shown in the figure) provided through ceramic substrate 51 or via metal coating (not shown in the figure) on the short side of the ceramic substrate 51. A grounding lead 55 is soldered to the outer ground plane at the centre of input/output leads 54. The grounding lead 55 located between input and output leads 54 is effective to electromagnetically shield the two leads 54. The grounding through-holes may be omitted, when the inner ground plane is grounded by other means. Grounding lead 55 may be omitted, when the ground plane 51'' can be grounded by other means. In addition to the advantage of the filter's less space occupancy, less number of the components is advantageous for cost reduction of the filter.

Figure 16:
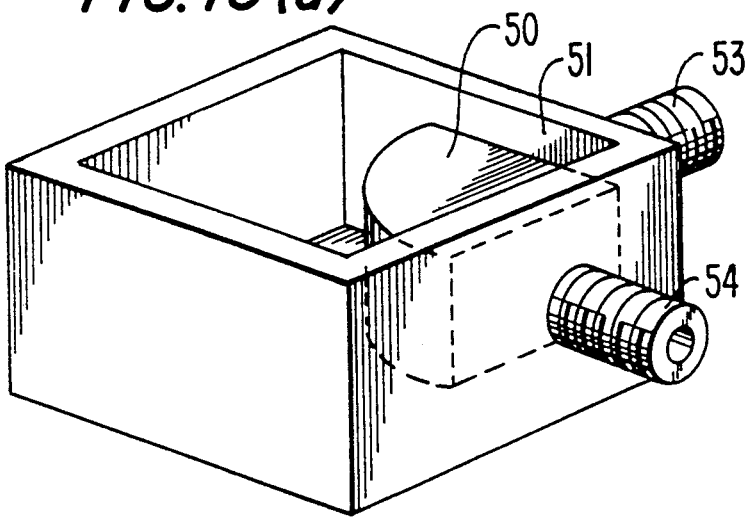
FIGS. 16(*a*) and 16(*b*) show a quarter-cut cylinder type resonator of the present invention according to a seventh embodiment.
Figure 16:
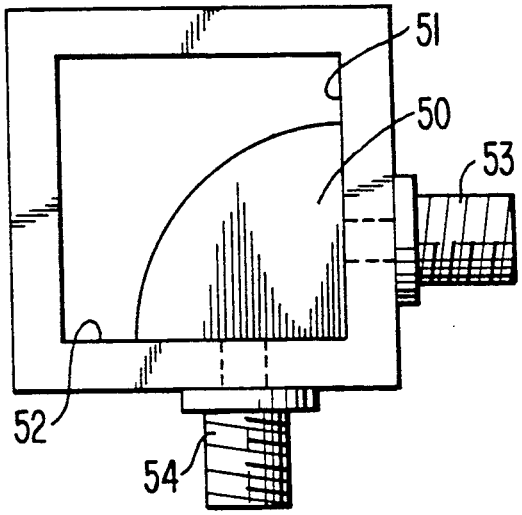

Though a half-cut cylinder type resonator element is referred to in the above preferred embodiments, it is apparent that the concept of the present invention can be embodied for coupling the input/output circuit to a quarter-cut cylinder resonator 50 as illustrated in FIGS. 16(*a*) and 16(*b*) element. The quarter-cut cylinder resonator element 50 is such that two of the radially cut sides, each including the axis of the cylinder and orthogonal to each other, cut a dielectric cylinder so as to leave a quarter of the cylinder. The radially cut sides are contacted respectively with two metal walls 51 and 52 orthogonal with each other. Each metal wall acts as mirror to form an image of the quarter cylinder so that the quarter-cut cylinder resonates equivalently in the $TE_{01\delta}$ mode of a complete cylinder. Quarter-cut cylinder resonator elements are reported in the above-cited IEEE Transaction. When a quarter-cut cylinder resonator element is provided with both the input and output terminals, the terminals 53 and 54 are provided on each of the two orthogonally arranged metal walls 51 and 52 illustrated in FIGS. 16(*a*) and 16(*b*).

Though in the above-described preferred embodiments a radially cut side of the resonator element is contacted with a metal wall, it is apparent that radially cut side of the resonator element may be metalized with an electrically conductive material, excepting the openings for the electrostatic coupling. The metalization is carried out by a generally employed technique, such as plating, sputtering, sintering or printing of copper, gold or silver, etc. The metalized side of the resonator element may be further contacted with the metal wall referred to in the above embodiments, or may be directly employed for constituting the transmission line. The metalization of the resonator element reduces improves the insertion loss in the bandpass characteristics caused from the used of organic adhesive material.

The many features and advantages of the invention are apparent from the detailed specification and thus, it is intended by the appended claims to cover all such features and advantages of the system which fall within the tru spirit and scope of the invention. Further, since numerous modifications and changes may readily occur to those skilled in the art, it is not desired to limit the invention to the exact construction and operation shown and described, and accordingly, all suitable modifications and equivalents may be resorted to, falling within the scope of the invention.

What is claimed is:

1. A dielectric resonator comprising:

a resonator element formed of a dielectric cylinder portion, the dielectric cylinder portion having an axis, a radial side lying in a plane containing the axis of the dielectric cylinder portion and two sides orthogonal to the axis;

an electrically conductive plane having a first surface in contact with the radial side of said resonator element, said resonator element resonating with a radio frequency signal equivalently in $TE_{01\delta}$-mode, said electrically conductive plane having at least one opening, the radial side of said resonator element facing the at least one opening; and a transmission line located opposite from said resonator element with respect to said electrically conductive plane, said transmission line operatively connected to the at least one opening, coupling an electromagnetic wave carried on said transmission line via the at least one opening to said resonator element.

2. A dielectric resonator as recited in claim 1, wherein said resonator element is formed of a half dielectric cylinder portion.

3. a dielectric resonator as recited in claim 1, wherein said electrically conductive plane is a metal plate supporting said resonator element.

4. A dielectric resonator as recited in claim 3, wherein the radial side of said resonator element is adhered to the metal plate.

5. A dielectric resonator as recited in claim 1, wherein said electrically conductive plane is a metal film plated on the radial side.

6. A dielectric resonator as recited in claim 1, wherein said electrically conductive plane is a metal deposition sputtered on the radial side.

7. A dielectric resonator as recited in claim 1, wherein said electrically conductive plane is metal powder painted on the radial side.

8. A dielectric resonator as recited in claim 1, wherein said electrically conductive plane is metal film sintered on the radial side.

9. A dielectric resonator as recited in claim 1, wherein said transmission line is an unbalanced transmission line.

10. A dielectric resonator as recited in claim 9, wherein said electrically conductive plane has a second surface opposite the first surface thereof, and wherein said unbalanced transmission line is a strip line type transmission line formed with a strip electrode and a dielectric layer between the strip electrode and the second surface of said electrically conductive plane, said resonator element electromagnetically coupled with an end of the strip electrode via the dielectric layer.

11. A dielectric resonator as recited in claim 10, wherein the end of the strip electrode extends through the dielectric layer towards the opening.

12. A dielectric resonator as recited in claim 9, wherein the unbalanced transmission line is a coaxial line, an outer conductor of the coaxial line being electromagnetically connected to said electrically conductive plane, an inner conductor of the coaxial line being electromagnetically coupled to said resonator element via the opening.

13. A dielectric resonator as recited in claim 1, wherein an additional opening is provided on said electrically conductive plane.

14. A dielectric resonator as recited in claim 13, wherein the opening and the additional opening are located at essentially equal distances from the axis of said cylinder.

15. A dielectric resonator as recited in claim 1, further comprising a cap partially enclosing said resonator element, formed of an electrically conductive material and electrically connected to said electrically conductive plane.

16. A dielectric resonator, comprising:

a resonator element formed of a dielectric cylinder portion having an axis, a first radial side lying in a first plane containing the axis of the dielectric cylinder portion, a second radial side perpendicular to the first radial side lying in a second plane containing the axis of the dielectric cylinder portion, and two sides orthogonal to said axis;

first and second electrically conductive planes having a first surface of said first electrically conductive plane contacting the first radial side and a first surface of said second electrically conductive plane contacting the second radial side, said resonator element resonating with a radio frequency signal equivalently in $TE_{01\delta}$-mode, at least one of said first and second electrically conductive planes having at least one opening, at least on of the first and second radial sides of said resonator element facing the at least one opening, respectively; and a transmission line located opposite from said resonator element with respect to at least one of said first and second electrically conductive planes, said transmission line being operatively connected to the at least one opening, coupling an electromagnetic wave carried on said transmission line via the at least one opening to said resonator element.

17. A dielectric resonator comprising:

a resonator element formed of a dielectric cylinder portion, the dielectric cylinder portion having an axis, a radial side lying in a plane containing the axis of the dielectric cylinder portion and two sides orthogonal to the axis;

an electrically conductive plane having a first surface in contact with the radial side of said resonator element, said electrically conductive plane having at least one opening, the radial side of said resonator element facing the at least one opening; and a transmission line located opposite from said resonator element with respect to said electrically conductive plane, said transmission line operatively connected to the at least one opening, coupling an electromagnetic wave carried on said transmission line via the at least one opening to said resonator element.

18. A dielectric resonator as recited in claim 17, wherein said resonator element is formed of a half dielectric cylinder portion.

19. A dielectric resonator as recited in claim 17, wherein said electrically conductive plane has a second surface opposite the first surface thereof, and wherein said transmission line is a strip line type transmission line formed with a strip electrode and a dielectric layer between the strip electrode and the second surface of said electrically conductive plane associated therewith, said resonator element electromagnetically coupled with an end of the strip electrode via the dielectric layer.

20. A dielectric resonator as recited in claim 17, wherein said transmission line is a coaxial line, an outer conductor of the coaxial line being electromagnetically connected to said electrically conductive plane, an inner conductor of the coaxial line being electromagnetically coupled to said resonator element via the opening.

21. A dielectric resonator, comprising:

a resonator element formed of a dielectric cylinder portion having an axis, a first radial side lying in a first plane containing the axis of the dielectric cylinder portion, a second radial side perpendicular to the first radial side lying in a second plane containing the axis of the dielectric cylinder portion, and two sides orthogonal to said axis;

first and second electrically conductive planes having a first surface of said first electrically conductive plane contacting the first radial side and a first surface of said second electrically conductive plane contacting the second radial side, at least one of the said first and second electrically conductive planes having at least one opening therein, at least one of the first and second radial sides of said resonator element facing the at least one opening; and a transmission line located opposite from said resonator element with respect to at least one of said first and second electrically conductive planes, said transmission line being operatively connected to the at least one opening, coupling an electromagnetic wave carried on said transmission line via the at least on opening to said resonator element.

22. A dielectric resonator as recited in claim 21, wherein said resonator element is formed of a quarter dielectric cylinder portion.

23. A dielectric resonator as recited in claim 21, wherein each of said first and second electrically conductive planes have second surfaces opposite the first surfaces thereof, and wherein said transmission line is a strip line type transmission line formed with a strip electrode and a dielectric layer between the strip electrode and the second surfaces of said first and second electrically conductive planes, said resonator element electromagnetically coupled with an end of the strip electrode via the dielectric layer.

24. A dielectric resonator as recited in claim 21, wherein said transmission line is a coaxial line, an outer conductor of the coaxial line being electromagnetically connected to said electrically conductive plane associated therewith, an inner conductor of the coaxial line being electromagnetically coupled to said resonator element via the at least one opening.

* * * * *

UNITED STATES PATENT AND TRADEMARK OFFICE

CERTIFICATE OF CORRECTION

PATENT NO. : 5,057,804

DATED : October 15, 1991

INVENTOR(S) : Sogo et al.

Figure 14A:
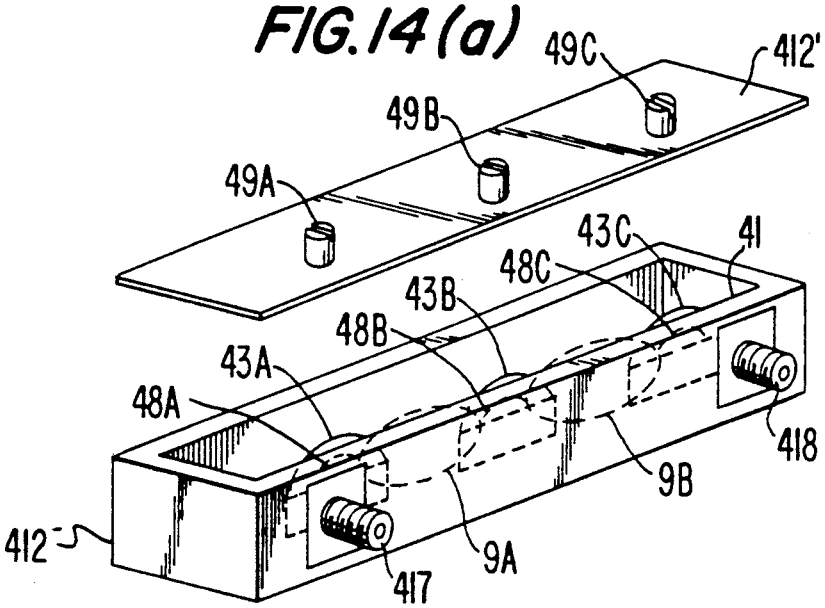
FIGS. 14(*a*) and 14(*b*) show a fifth preferred embodiment of the present invention.
Figure 14B:
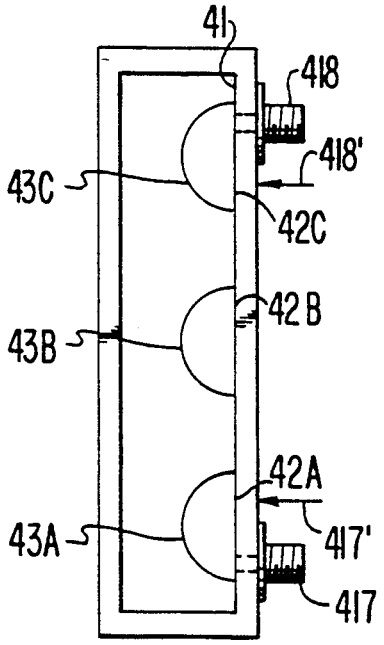

It is certified that error appears in the above-identified patent and that said Letters Patent is hereby corrected as shown below:

Col. 6, line 3, "filte" should be --filter--;

line 12, "FIGS. 14," should be --FIGS. 14(a) & 14(b),--;

line 52, "FIGS. 14" should be --FIGS. 14(a) & 14(b)--;

line 66, "invention This" should be --invention. This--;

line 68, "Mega Hertz" should be --Mega-Hertz--.

Col. 7, line 46, "resonator 50" should be --resonator element 50--;

line 47, "16(b) element." should be --16(b).--.

Col. 8, line 14, "tru" should be --true--.

Signed and Sealed this

Eleventh Day of May, 1993

*Attest:*

Michael K. Kirk

MICHAEL K. KIRK

*Attesting Officer*

*Acting Commissioner of Patents and Trademarks*